US008680696B2

(12) United States Patent
Mikus

(10) Patent No.: US 8,680,696 B2
(45) Date of Patent: Mar. 25, 2014

(54) POWER PLANT WITH MAGNETOHYDRODYNAMIC TOPPING CYCLE

(75) Inventor: Thomas Mikus, Houston, TX (US)

(73) Assignee: Shell Oil Company, Houston, TX (US)

( * ) Notice: Subject to any disclaimer, the term of this patent is extended or adjusted under 35 U.S.C. 154(b) by 45 days.

(21) Appl. No.: 13/577,270

(22) PCT Filed: Feb. 8, 2011

(86) PCT No.: PCT/US2011/024044

§ 371 (c)(1),
(2), (4) Date: Aug. 6, 2012

(87) PCT Pub. No.: WO2011/097622

PCT Pub. Date: Aug. 11, 2011

(65) Prior Publication Data

US 2012/0306208 A1 Dec. 6, 2012

Related U.S. Application Data

(60) Provisional application No. 61/302,359, filed on Feb. 8, 2010.

(51) Int. Cl.

| | |
|---|---|
| ***F02B 63/04*** | (2006.01) |
| ***F03G 7/08*** | (2006.01) |
| ***H02K 7/18*** | (2006.01) |
| *G21D 7/02* | (2006.01) |
| *H02K 44/00* | (2006.01) |

(52) U.S. Cl.
USPC ..... 290/1 R; 310/11

(58) Field of Classification Search
USPC ..... 290/1 R; 310/11
See application file for complete search history.

(56) References Cited

U.S. PATENT DOCUMENTS

| | | | | | |
|---|---|---|---|---|---|
| 3,319,090 | A | * | 5/1967 | Dzung | 310/11 |
| 3,444,401 | A | * | 5/1969 | Gilli | 310/11 |
| 3,683,621 | A | * | 8/1972 | Szewalski | 60/647 |
| 3,720,850 | A | * | 3/1973 | Way | 310/11 |
| 3,889,470 | A | * | 6/1975 | Szewalski | 60/647 |
| 3,895,243 | A | * | 7/1975 | Amend et al. | 310/11 |
| 3,980,907 | A | * | 9/1976 | Nakamura | 310/11 |
| 3,999,089 | A | * | 12/1976 | Barros | 310/11 |
| 4,163,910 | A | * | 8/1979 | Matthews et al. | 310/11 |
| 4,282,449 | A | * | 8/1981 | Bozzuto | 310/11 |
| 4,345,173 | A | * | 8/1982 | Marchant et al. | 310/11 |
| 4,346,302 | A | | 8/1982 | Bozzuto | 290/1 R |

(Continued)

FOREIGN PATENT DOCUMENTS

| | | | |
|---|---|---|---|
| EP | 1441434 | 7/2004 | H02K 44/08 |

*Primary Examiner* — Pedro J Cuevas

(57) ABSTRACT

A system and method for generating power, comprises providing a fuel stream and an oxygen stream to a magnetohydrodynamic generator so as to generate electric power and a first exhaust stream comprising $CO_2$ and water; and providing the first exhaust stream to an expansion generator so as to generate electric power and a second exhaust stream comprising $CO_2$ and water at a lower temperature and pressure than the first exhaust steam. The system and method may include the step of separating air upstream of the magnetohydrodynamic generator so as to generate the oxygen stream and may include the step of condensing the second exhaust stream so as to generate water and a wet $CO_2$ stream. The wet $CO_2$ stream may be condensed so as to generate water and a dry $CO_2$ stream, which may be stored underground.

15 Claims, 1 Drawing Sheet

(56) References Cited

U.S. PATENT DOCUMENTS

| | | | | | |
|---|---|---|---|---|---|
| 4,426,354 | A | * | 1/1984 | Scragg et al. | 376/320 |
| 4,450,361 | A | | 5/1984 | Hold | 290/1 R |
| 4,454,865 | A | * | 6/1984 | Tammen | 126/640 |
| 4,500,803 | A | * | 2/1985 | Hayes | 310/11 |
| 4,505,795 | A | * | 3/1985 | Alamaro | 204/179 |
| 4,516,043 | A | * | 5/1985 | Vigil et al. | 310/11 |
| 4,645,959 | A | * | 2/1987 | Dobran | 310/11 |
| 4,816,211 | A | * | 3/1989 | Parker et al. | 376/323 |
| 4,986,160 | A | * | 1/1991 | Kemeny | 89/8 |
| 5,086,234 | A | | 2/1992 | Shiota et al. | 290/52 |
| 5,160,694 | A | * | 11/1992 | Steudtner | 376/107 |
| 5,254,934 | A | * | 10/1993 | Carabetta et al. | 322/2 R |
| 5,260,640 | A | * | 11/1993 | Carabetta et al. | 322/2 R |
| 5,680,764 | A | | 10/1997 | Viteri | 60/716 |
| 5,970,702 | A | | 10/1999 | Beichel | 60/39.05 |
| 7,043,920 | B2 | | 5/2006 | Viteri et al. | 60/716 |
| 2013/0154269 | A1 | * | 6/2013 | Baldwin | 290/54 |

* cited by examiner

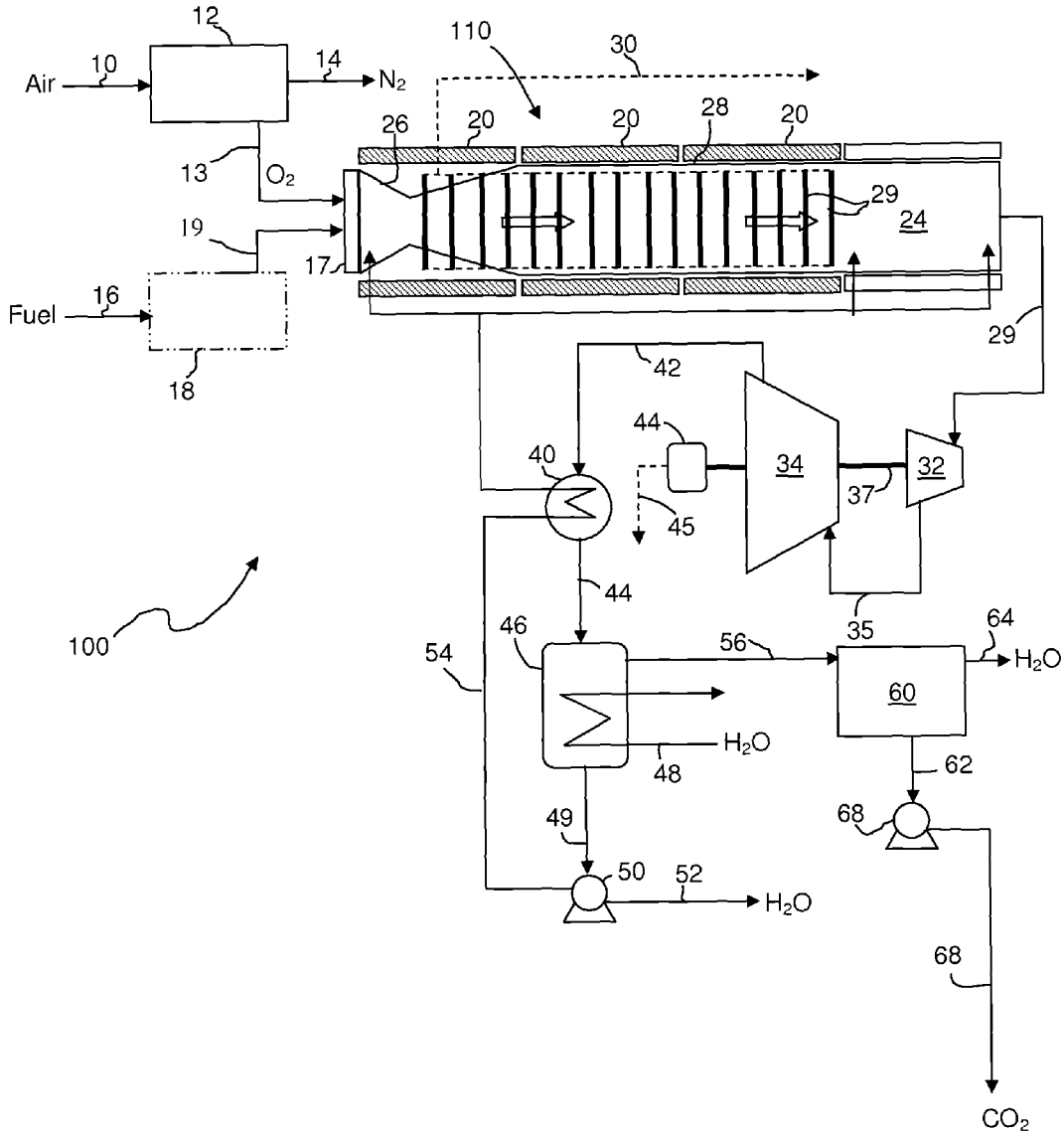
12
Air
10
14
$N_2$
110
30
26
20
20
28
20
13
$O_2$
29
24
19
17
Fuel
16
18
29
42
44
40
34
32
37
45
44
100
46
35
64
54
56
$H_2O$
60
$H_2O$
48
62
49
68
50
52
$H_2O$
68
$CO_2$

POWER PLANT WITH MAGNETOHYDRODYNAMIC TOPPING CYCLE

PRIORITY CLAIM

The present application claims priority from PCT/US2011/024044, filed 8 Feb. 2011, which claims priority from U.S. provisional 61/302,359, filed 8 Feb. 2010.

FIELD OF THE INVENTION

The invention relates to power generation and more specifically to an oxygen-fired power generator that includes a furnace, a magnetohydrodynamic generator, and gas separation units that allow high efficiency power generation in combination with $CO_2$ capture and sequestration.

BACKGROUND OF THE INVENTION

High-pressure combustion technology is increasingly used for power generation. As with all combustion-based power generation, emissions are a primary concern. Some commercially available systems are based on a combustor that burns a gaseous, liquid, or solid fuel using gaseous oxygen at near-stoichiometric conditions in the presence of recycled water. The products of this combustion are primarily a high temperature, high pressure mixture of steam and $CO_2$. Fuels that are suitable for combustion in such a system include natural gas, syngas from coal, refinery residues, landfill gas, bio-digester gases, coal, liquid hydrocarbons, and renewable fuels such as glycerin from bio-diesel production facilities.

The hot, high pressure output of a combustor can be used to drive conventional or advanced steam turbines or modified aero-derivative gas turbines that operate at high temperatures and intermediate pressures. Downstream of the turbines, the exhaust gases can be separated and the separated $CO_2$ can be sequestered or stored so as to avoid venting greenhouse gases. Systems such as this are available from Clean Energy Systems of Rancho Cordova, Calif.

Despite advances in combustion and turbine technologies, it remains desirable to further increase the efficiency of combustion-based power generation systems.

SUMMARY OF THE INVENTION

The present invention provides a combustion-based power generation system that includes a magnetohydrodynamic device that produces power from the flow of very high temperature, high pressure gas leaving the combustion zone and thereby increases the energy output and efficiency of the system while still allowing power generation and separation and recovery of $CO_2$ from the exhaust gases.

In preferred embodiments of the invention, a magnetohydrodynamic (MHD) generator transforms thermal energy or kinetic energy directly into electricity. An MHD generator produces power by moving a conductor through a magnetic field. In a standard electrical generator, the moving conductor is typically a coil of copper wire. In an MHD, the conductor is a fast-moving hot plasma gas. Thus, unlike a standard electrical generator, the MHD contains no moving parts.

In a conventional MHD generator, a high-temperature, electrically conductive gas flows past a transverse magnetic field. An electric field is generated perpendicular to the direction of gas flow and the magnetic field. The electric field generated is directly proportional to the speed of the gas, its electrical conductivity, and the magnetic flux density. Electrical power can be extracted from the system using electrodes placed in contact with the flowing plasma gas.

The conducting gas in an MHD generator is a plasma created by thermal ionization, in which the temperature of the gas is high enough to separate the electrons from the atoms of gas. These free electrons make the plasma electrically conductive. Creation of the plasma requires very high temperatures, but the temperature threshold can be lowered by seeding the gas with an alkali metal compound, such as potassium carbonate. The alkali metal ionizes more readily at lower temperatures. Thus, preferred MHD systems include seeding the plasma upstream of the generator and recovering and recycling the seed material downstream of the generator.

In preferred embodiments of the invention, an MHD generator is positioned immediately downstream of a combustor and the plasma is the output of the combustor.

Conventional coal-fired generators achieve a maximum efficiency of about 35%. MHD generators have the potential to reach 50%-60% efficiency. The higher efficiency is due to recycling the energy from the hot plasma gas to standard steam turbines. After the plasma gas passes through the MHD generator, it is still hot enough to raise steam to drive turbines that produce additional power.

Further, in combustion systems in which the exhaust gas must otherwise be quenched before it can be fed to the turbines, insertion of an MHD generator downstream of the combustor can increase efficiency by extracting energy from the exhaust gas as electric power before it reaches the turbines. By reducing the amount of energy lost in the quenching step, or removing the quench step completely, more of the energy of combustion can be used for power generation.

BRIEF DESCRIPTION OF THE DRAWING

For a more detailed understanding of the invention, reference is made to the accompanying drawing, which is a schematic diagram of a system incorporating an MHD topping cycle with a oxygen-fired, power-generating combustion system.

DETAILED DESCRIPTION OF A PREFERRED EMBODIMENT

Referring to the drawing, preferred embodiments of the invention comprise a system 100 in which fuel is burned with oxygen and the resulting high temperature gases are processed in an MHD generator 110 and an expansion-turbine system to extract energy.

More specifically, air is fed via line 10 into an air separation unit 12, from which nominally pure oxygen exits via line 13 and nitrogen exits via line 14. Fuel is provided via line 16 and may be processed in an optional processing/seeding unit 18 if desired. Oxygen in line 13 and fuel in line 19 enter an MHD injector manifold 17, where combustion occurs, generating exhaust gases at high temperature and pressure. In some embodiments, the temperature of the exhaust gases leaving manifold 17 will be in the range of 2500° C. to 3400° C. and the pressure will be in the range of 5 MPa to 20 MPa. Manifold 17 is preferably constructed using diffusion-bonded platelet technology and is designed so that it precisely distributes and pre-mixes fuel, oxygen and water before injection into the combustor.

The fuel that may be used in the present system includes but is not limited to natural gas, coal-based syngas, and bitumen-based fuel emulsions.

The high-temperature, high-pressure gases leaving manifold 17 flow into an MHD nozzle 26, which further increases their velocity. From nozzle 26, the gases flow into an MHD diffuser section 28, in which the temperature decreases gradually. The temperature is preferably lowered to a range that can be accommodated by the downstream equipment. Thus, in some embodiments, the temperature of the gases leaving diffuser section 28 is preferably less than 1650° C. and the pressure is preferably in the range of 2 to 10 MPa. If necessary, additional water may be used to quench the exhaust gases so as to reduce the temperature below 1650° C.

As shown in the drawing, MHD nozzle 26 and diffuser section 28 are each positioned between superconducting magnets 20, which are preferably pairs of magnets that enclose the flow path of the gases and generate a magnetic field perpendicular to the direction of flow of the gas. In addition, a plurality of electrodes 29 are positioned around the flow path, perpendicular to both the fluid flow path and the direction of the magnetic field created by magnets 20. As described above, the flow of hot plasma through this magnetic field will generate electric current in electrodes 29. The current can be carried from the system for use via conductors 30. Various configurations for magnets 20 and electrodes 29 are known, including the Faraday generator, Hall generator, and disc generator configurations, with the latter being the most efficient.

Internally-cooled cabled superconducting (ICCS) magnets are preferred for magnets 20 in order to reduce parasitic losses. Once charged, ICCS magnets consume very little power and can develop intense magnetic fields of 6 T and higher. The only parasitic load imposed by these magnets is to maintain cryogenic refrigeration and to make up the small losses for the non-supercritical connections.

Electrodes 29 need to carry a relatively high electric current density. In addition, electrodes 29 are exposed to high heat fluxes. Because of the combination of high temperature, chemical attack and electric field, it is preferred that the non-conducting walls of the electrodes 29 be constructed from an extremely heat-resistant substance such as yttrium oxide or zirconium dioxide in order to retard oxidation.

In preferred embodiments, the plasma gas is expanded supersonically in the MHD generator in order to overcome the deceleration that results from interaction with the magnetic field. The extraction of electrical energy causes the plasma temperature to drop. In preferred embodiments, diffuser section 28 is profiled so as to maintain a constant Mach number until the temperature becomes too low to have any useful electric conductivity. For example, the plasma temperature might be lowered to approximately 1900° C. by the MHD, from which point the gas could be quenched with water to accommodate expansion-turbine inlet-temperature limitations as described below.

Downstream of the MHD generator, the hot gases flow via line 29 into a first high-pressure turbine 32 and from there via line 35 into a second intermediate-pressure turbine 34. Turbines 32, 34 may be conventional expansion turbines, which form a bottoming cycle for the MHD and generate additional electric power via a shaft 37 connected to a generator 44. Current is carried from generator 44 for use via conductor 45.

Gases leaving the second turbine 34 are at lower temperature and pressure than those entering the first turbine 32. In some embodiments, they may be at temperatures in the range of from 100 to 500° C. and at pressures in the range of from 0.02 to 0.5 MPa. The gases leave turbine 34 via line 42 and preferably flow into a first heat exchanger 40, where they are cooled further by thermal contact with a flow of water in line 54, described below. In some embodiments, gas leaving heat exchanger 40 may be at temperatures in the range of from 50 to 150° C. and at pressures slightly below the inlet pressure. From heat exchanger 40, the gases flow via line 44 into a condenser 46, where they are further cooled and condensed by thermal contact with chilled water in a line 48. Condenser 46 also provides a location to retrieve the optional seed material for recycle to fuel processing/seeding unit 18.

Water condensed in condenser 46 flows via a line 49 to a pump 50, where it is pumped into line 54 for recycling into MHD generator 110 after passage through heat exchanger 40 as described above. If the water is in excess of what is needed in the MHD generator, it may be pumped to storage.

After condensation of the water, the gas remaining in condenser 46 comprises wet $CO_2$, which is preferably sent via a line 56 to a dehydration and compression unit 60. Water removed in dehydration and compression unit 60 may be sent to storage or recycled, as desired. Dried, pressurized $CO_2$ leaves dehydration and compression unit 60 via a line 62 and is preferably compressed or pumped by unit 68 to a desired location. In some preferred embodiments, the $CO_2$ may be used in enhanced oil recovery operations, such as are known in the art, or may be sequestered underground. It will be understood that the dried, pressurized $CO_2$ generated by this process is suitable for many applications.

The advantages of the present invention are significant. In addition to increasing the efficiency of a oxy-fired expansion-cycle power plant by extracting energy from the step-down from combustion conditions to turbine conditions, MHD generators are ecologically sound and can burn coal with high sulfur content without polluting the atmosphere. MHD generators operate without moving parts and are therefore not susceptible to wear-induced failure.

What is claimed is:

1. A power generation system, comprising:

a magnetohydrodynamic generator receiving a fuel stream and an oxygen stream and generating electric power and a first exhaust stream comprising $CO_2$ and water; and an expansion generator receiving the first exhaust stream and generating electric power and a second exhaust stream comprising $CO_2$ and water at a lower temperature and pressure than the first exhaust steam.

2. The system described in claim 1 wherein the expansion generator is an expansion turbine.

3. The system according to claim 1, further including a condenser receiving the second exhaust stream and generating water and a wet $CO_2$ stream.

4. The system according to claim 3, further including a dehydration and compression unit receiving wet $CO_2$ stream and generating water and a dry $CO_2$ stream.

5. The system according to claim 3 wherein the water generated in the condenser is recycled into the magnetohydrodynamic generator.

6. The system according to claim 1, further including an air separation unit upstream of the magnetohydrodynamic generator, the air separation unit generating said oxygen stream.

7. The system according to claim 1 wherein the first exhaust stream consists essentially of $CO_2$ and water.

8. The system according to claim 1 wherein the expansion generator is selected from the group consisting of a Rankine cycle generator and a Brayton cycle generator.

9. A method for generating power, comprising:

a) providing a fuel stream and an oxygen stream to a magnetohydrodynamic generator so as to generate electric power and a first exhaust stream comprising $CO_2$ and water; and b) providing the first exhaust stream to an expansion generator so as to generate electric power and a second exhaust stream comprising $CO_2$ and water at a lower temperature and pressure than the first exhaust steam.

10. The method described in claim 9 wherein the expansion generator uses a polytropic expansion.

11. The method according to claim 9, further including the step of separating air upstream of the magnetohydrodynamic generator so as to generate the oxygen stream.

12. The method according to claim 9, further including the step of condensing the second exhaust stream so as to generate water and a wet $CO_2$ stream.

13. The method according to claim 12, further including the step of dehydrating and compressing the wet $CO_2$ stream so as to generate water and a dry $CO_2$ stream.

14. The method according to claim 13, further including the step of pumping the dry $CO_2$ underground.

15. The method according to claim 13, further including the step of using the dry $CO_2$ in enhanced oil recovery.

* * * * *